US009063468B2

(12) United States Patent
Wada et al.

(10) Patent No.: US 9,063,468 B2
(45) Date of Patent: Jun. 23, 2015

(54) DEVELOPING DEVICE AND IMAGE FORMING APPARATUS PROVIDED THEREWITH

(71) Applicant: KYOCERA Document Solutions Inc., Osaka (JP)

(72) Inventors: Minoru Wada, Osaka (JP); Takahisa Nakaue, Osaka (JP); Tamotsu Shimizu, Osaka (JP); Ikuo Makie, Osaka (JP); Kenichi Tamaki, Osaka (JP); Takefumi Yotsutsuji, Osaka (JP); Shizuka Okada, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/180,793

(22) Filed: Feb. 14, 2014

(65) Prior Publication Data

US 2014/0233985 A1 Aug. 21, 2014

(30) Foreign Application Priority Data

Feb. 18, 2013 (JP) ..... 2013-028871

(51) Int. Cl.
*G03G 15/08* (2006.01)
*G03G 15/09* (2006.01)

(52) U.S. Cl.
CPC ..... *G03G 15/0921* (2013.01); *G03G 15/0832* (2013.01); *G03G 2215/0838* (2013.01)

(58) Field of Classification Search
CPC ..... G03G 15/0832; G03G 15/0839; G03G 21/1676
See application file for complete search history.

(56) References Cited

U.S. PATENT DOCUMENTS 6,415,125 B1 * 7/2002 Yamamoto et al. ..... 399/254

FOREIGN PATENT DOCUMENTS

JP 2005-346116 A 12/2005

* cited by examiner

*Primary Examiner* — David Gray
*Assistant Examiner* — Erika J Villaluna
(74) *Attorney, Agent, or Firm* — Knobbe, Martens, Olson & Bear LLP

(57) ABSTRACT

A developing device includes: a housing, a refill developer storage part, a developing roller, a developer conveyance path, a developer receiving port, a conveyance member, and a magnetic member. The developing roller is driven into rotation in the developing housing and carries a toner on a circumferential surface thereof. The toner is conveyed inside the first conveyance path and the second conveyance path of the developing housing in a circulating manner. A first stirring screw is disposed on the first conveyance path and conveys the toner in a first direction. Downstream of the toner refill port, a magnet is arranged. The magnetic member forms a magnetic brush from a top panel of the developing housing towards the first stirring screw. A refill toner flowed-in through the toner refill port is so conveyed as to fall below the magnetic brush whereby the refill toner is favorably stirred with a surrounding toner.

6 Claims, 9 Drawing Sheets

DEVELOPING DEVICE AND IMAGE FORMING APPARATUS PROVIDED THEREWITH

INCORPORATION BY REFERENCE

This application claims priority to Japanese Patent Application No. 2013-28871 filed on Feb. 18, 2013, the entire contents of which are incorporated by reference herein.

BACKGROUND

This disclosure relates to a developing device favorably loaded on an image forming apparatus such as a copier or a printer, and the image forming apparatus provided therewith.

An image forming apparatus is provided with a developing device. The developing device is composed of a developing housing provided with a developing roller and a stirring screw; and a toner container detachably fitted to this developing housing for toner refill. Provided at a bottom part of the toner container is an openable and closable toner discharge port, and provided at a position corresponding to the toner discharge port in the developing housing is a toner refill port.

After the toner container is fitted to the developing housing and the toner discharge port and the toner refill port are opened, a toner in the toner container is supplied to a predetermined circulatory conveyance path formed in the developing housing.

The circulatory conveyance path is composed of: an outward conveyance path corresponding to the toner refill port; and a return conveyance path corresponding to the developing roller. Each circulatory conveyance paths is fitted with a stirring screw having a screw blade disposed around a rotation axis. A toner is conveyed by these stirring screws between the outward conveyance path and the return conveyance path in a circulating manner.

SUMMARY

As one aspect of this disclosure, a technology obtained further improving the aforementioned technology is to be suggested.

A developing device according to one aspect of this disclosure includes: a housing, a refill developer storage part, a developing roller, a developer conveyance path, a developer receiving port, a conveyance member, and a magnetic member.

The housing includes: a pair of wall parts, and a top panel being provided between the pair of wall parts in a manner such as to bridge therebetween, and stores a developer.

The refill developer storage part is attachable and detachable to and from the housing and stores a refill developer to be refilled to the housing.

The developing roller is rotatably supported by the housing between the pair of wall parts and carries the developer.

The developer conveyance path includes: a first conveyance path being arranged in the housing in a manner such as to be spaced from the developing roller and having the developer conveyed therethrough in a first direction, and a second conveyance path being arranged between the developing roller and the first conveyance path, having the developer conveyed therethrough towards a second direction opposite to the first direction, and supplying the developer to the developing roller, and has a top thereof defined by the top panel and has the developer conveyed therethrough in a circulating manner;

The developer receiving port is disposed at the top panel oppositely to the first conveyance path and receives the refill developer onto the first conveyance path.

The conveyance member is disposed on the first conveyance path, is driven into rotation, and conveys the developer in the first direction in a manner such that the developer passes through a position where the developer receiving port opposes the first conveyance path.

The magnetic member is arranged in the housing and forms, on the first conveyance path downstream of the developer receiving port in the first direction, a magnetic brush of the developer directed from the top panel towards the conveyance member.

DETAILED DESCRIPTION

Figure 1:
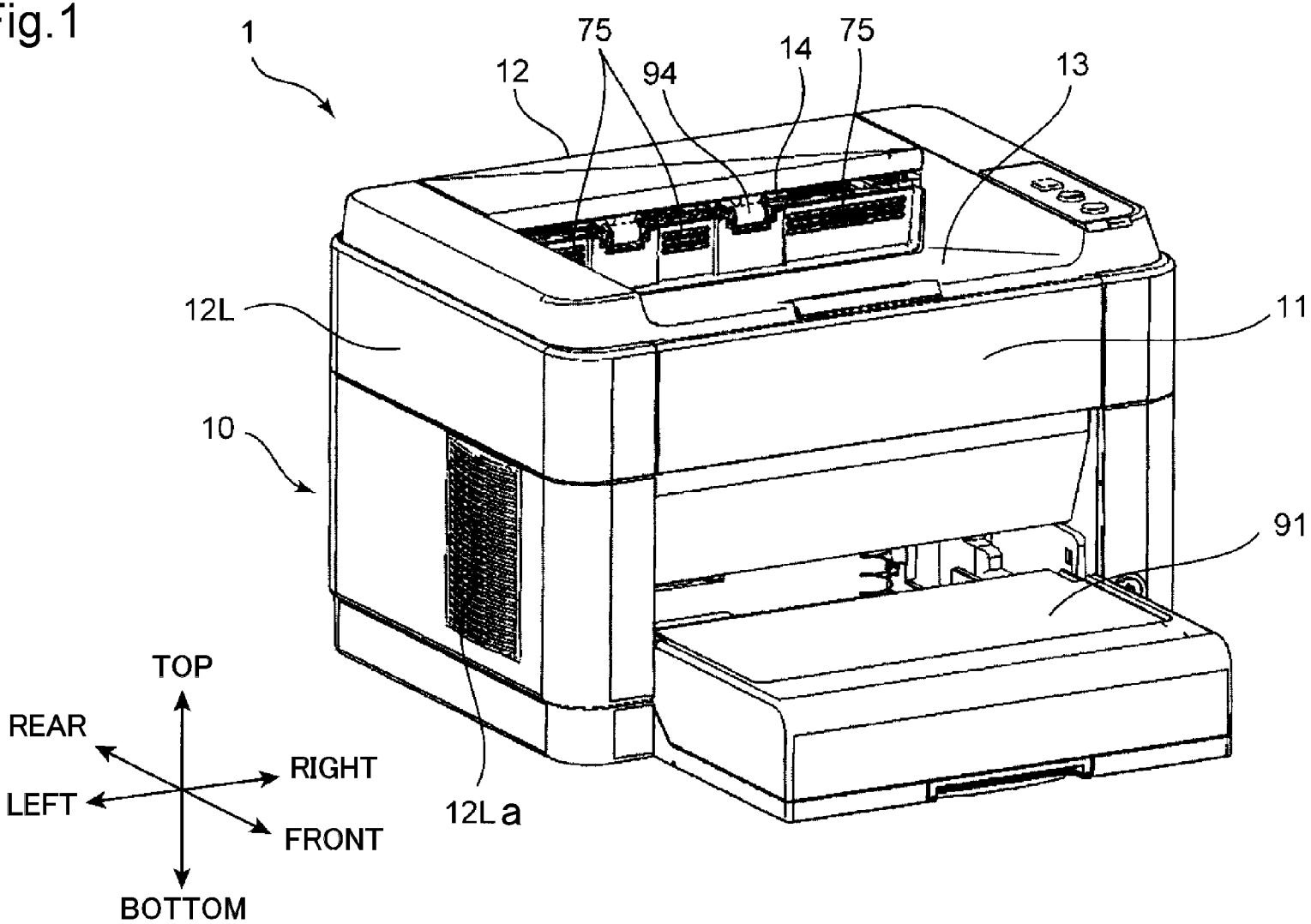
FIG. 1 is a perspective view showing exterior appearance of an image forming apparatus according to one embodiment of this disclosure.
Figure 2:
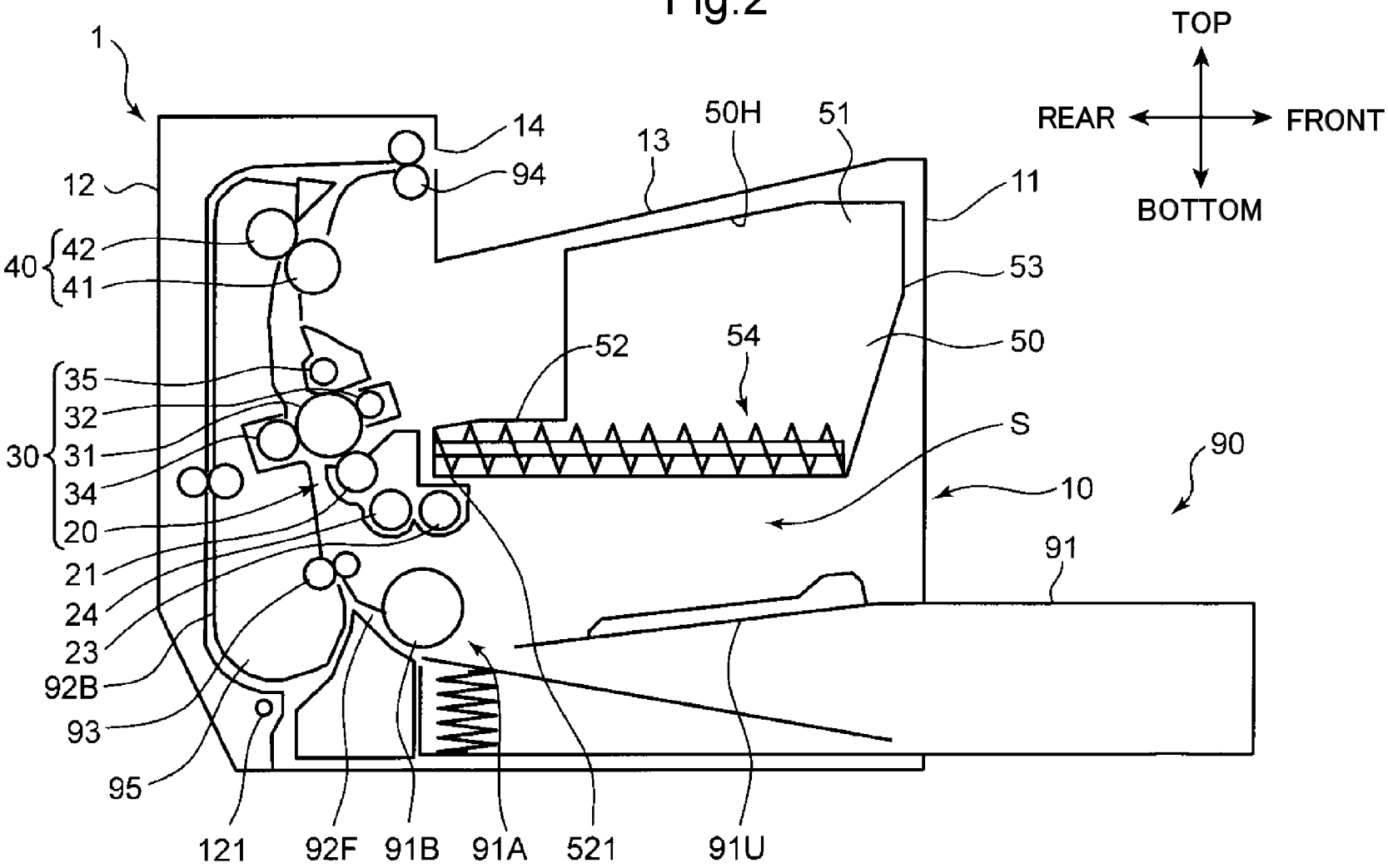
FIG. 2 is a sectional view showing internal structure of the image forming apparatus according to one embodiment of this disclosure.

Hereinafter, a developing device and an image forming apparatus according to embodiments as one aspect of this disclosure will be described with reference to the drawings. FIG. 1 is a perspective view showing exterior appearance of an image forming apparatus 1 according to one embodiment of this disclosure. FIG. 2 is a side sectional view showing internal structure of the image forming apparatus 1 according to one embodiment of this disclosure. Here, illustrated as the image forming apparatus 1 is a black and white printer, but the image forming apparatus may be a copier, a facsimile device, or a complex machine including the aforementioned functions, or an image forming apparatus forming a color image.

The image forming apparatus 1 includes: a main body housing 10 having a casing structure of a substantially rectangular shape; an image forming part 30; a fixing part 40; a toner container 50; and a paper feed part 90 which are all stored in this main body housing 10.

On a front side of the main body housing 10, a front cover 11 is provided, and on a rear side of the main body housing 10, a rear cover 12 is provided. As a result of opening the front cover 11, the toner container 50 is exposed to the front. As a result, a user can take out the toner container 50 from the front side of the main body housing 10 upon toner depletion. The rear cover 12 is a cover opened upon sheet jam or maintenance. As a result of opening of the rear cover 12, each unit of the image forming part 30 and the fixing unit 40 can be taken out from the rear side of the main body housing 10.

Moreover, on side surfaces of the main body housing 10, a left cover 12L (FIG. 1) and a right cover 12R (not shown in FIG. 1) opposite to the left cover 12L are respectively disposed in a manner such as to extend vertically. Disposed at a front side portion of the left cover 12L is a suction port 12La for introducing air into the main body housing 10. Moreover, provided on a top surface of the main body housing 10 is a paper discharge part 13 to which a sheet with an image already formed thereon is discharged. In an internal space S (FIG. 2) defined by the front cover 11, the rear cover 12, the left cover 12L, the right cover 12R, and the paper discharge part 13, various devices for executing image formation are fitted.

The image forming part 30 performs image formation processing in which a toner image is formed on a sheet sent from the paper feed part 90. The image forming part 30 includes: a photosensitive drum 31 (image carrier); and a charging device 32, an exposure device (not shown in FIG. 2), a developing device 20, a transfer roller 34, and a cleaning device 35 which are arranged around the photosensitive drum 31. The image forming part 30 is disposed between the left cover 12L and the right cover 12R.

The photosensitive drum 31 includes: a rotation shaft; and a cylindrical surface rotating around the rotation shaft. On the cylindrical surface, an electrostatic latent image is formed and also a toner image in accordance with this electrostatic latent image is carried. Used as the photosensitive drum 31 can be a photosensitive drum using an amorphous-silicon (a-Si)-based material.

The charging device 32 evenly charges a surface of the photosensitive drum 31, and includes a charging roller that abuts the photosensitive drum 31.

The cleaning device 35 has a cleaning blade, not shown, and cleans a toner adhering to a circumferential surface of the photosensitive drum 31 on which a toner image is transferred, and also conveys the toner to a collection device, not shown.

Figure 3:
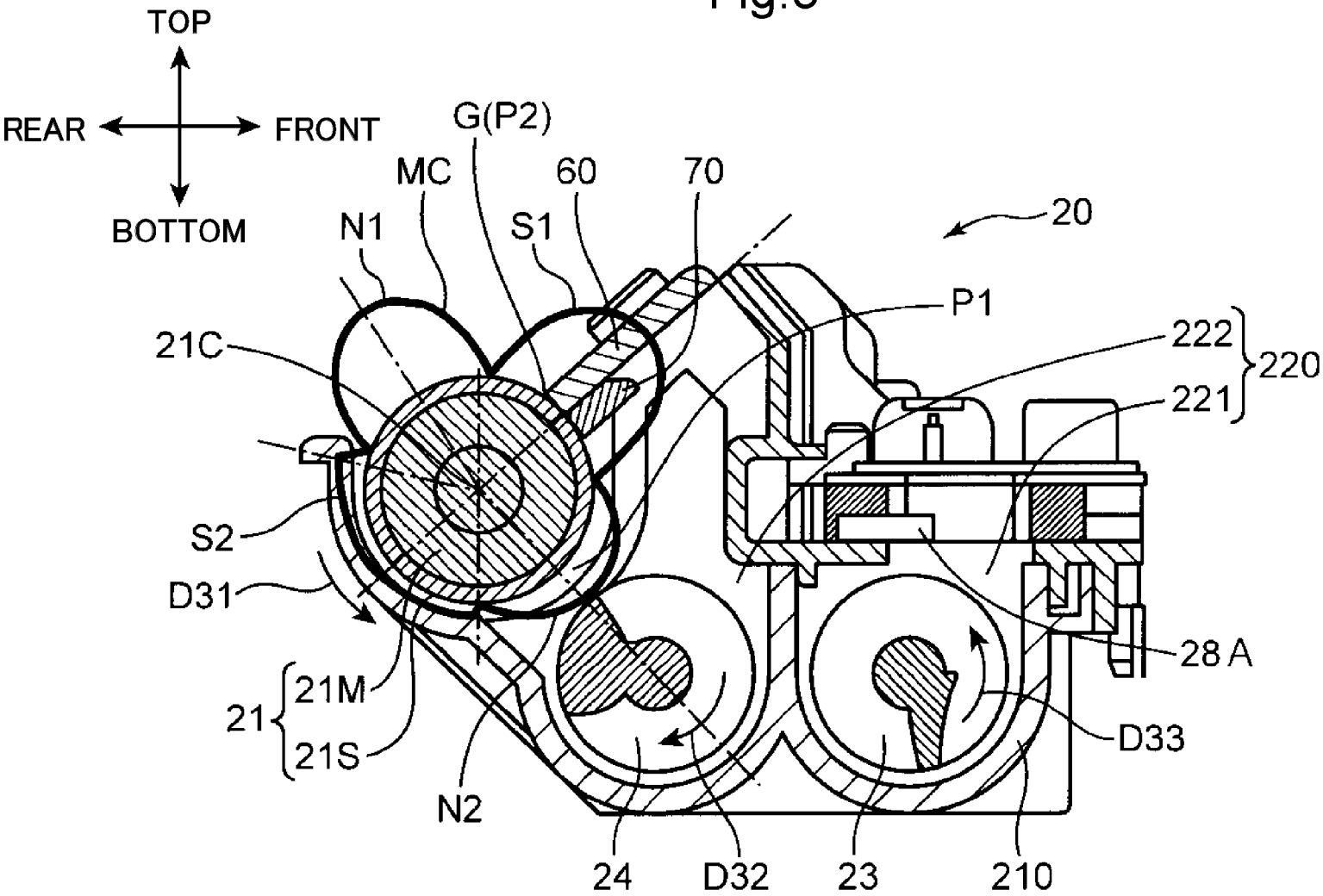
FIG. 3 is a sectional view of a developing device according to a first embodiment of this disclosure, viewed from a side.

The exposing device has optical devices such as a laser light source, a mirror, and a lens, and irradiates the circumferential surface of the photosensitive drum 31 with light modulated based on image data given from an external device such as a personal computer and thereby forms an electrostatic latent image. The developing device 20, in order to develop the electrostatic latent image on the photosensitive drum 31 to form a toner image, supplies the toner to the circumferential surface of the photosensitive drum 31. The developing device 20 includes: a developing roller 21 carrying a toner supplied to the photosensitive drum 31; and a first stirring screw 23 and a second stirring screw 24 cyclically conveying a developer while stirring it inside a developing housing 210 (FIG. 3). The developing device 20 according to this embodiment will be described in detail later.

The transfer roller 34 is a roller for transferring, onto a sheet, the toner image formed on the circumferential surface of the photosensitive drum 31. The transfer roller 34 abuts the cylindrical surface of the photosensitive drum 31, forming a transfer nip part. This transfer roller 34 is provided with transfer bias with a polarity opposite to that of the toner.

The fixing unit 40 performs fixing processing in which the transferred toner image is fixed on the sheet. The fixing unit 40 includes: a fixing roller 41 having a heat source provided therein; and a pressure roller 42 which is brought into pressure-contact with the fixing roller 41, forming a fixing nip part with the fixing roller 41. Upon passage of the sheet, on which the toner image has been transferred, through the fixing nip part, the toner image is fixed onto the sheet as a result of heating by the fixing roller 41 and pressing by the pressure roller 42.

The toner container 50 (refill developer storage part) pools a refill toner (refill developer) refilled into the developing device 20. The toner container 50 includes: a container main body 51 serving as a main refill toner pooling section; a tubular part 52 protruding from a bottom part on one side surface of the container main body 51; a cover member 53 covering another side surface of the container main body 51; and a rotation member 54 which is stored inside the container and which conveys a toner. As a result of driving of the rotation member 54 into rotation, the refill toner pooled in the toner container 50 is supplied into the developing device 20 from a toner discharge port 521 provided at a tip bottom surface of the tubular part 52. A container top board 50H covering a top of the toner container 50 is located below the paper discharge part 13 (see FIG. 2).

The paper feed part 90 includes a paper feed cassette 91 storing sheets to be subjected to image formation processing (FIG. 2). This paper feed cassette 91 partially protrudes even more forwardly from a front surface of the main body housing 10. Of the paper feed cassette 91, a top surface of a portion stored in the main body housing 10 is covered by a paper feed cassette top board 91U. Provided in the paper feed cassette 91 are: a sheet storage space in which a bundle of the sheets are stored; a lift board that lifts up the bundle of the sheets for the purpose of paper feeding; and so on. Provided at a top part on a rear end side of the paper feed cassette 91 is a sheet feed unit 91A. Arranged on this sheet feed unit 91A is a paper feed roller 91B for individually feeding the sheets at a topmost layer included in the bundle of sheets in the paper feed cassette 91.

Provided in the main body housing 10 are a main conveying path 92F and an inverted conveying path 92B for sheet conveyance. The main conveying path 92F extends via the image forming part 30 and the fixing unit 40 from the sheet feed unit 91A of the paper feed part 90 to a paper discharge port 14 provided oppositely to the paper discharge part 13 on the top surface of the main body housing 10. The inverted conveying path 92B is a conveying path for, upon performance of double-sided printing on a sheet, returning the sheet subjected to one-sided printing to an upstream side of the image forming part 30 in the main conveying path 92F.

The main conveying path 92F extends in a manner such as to pass through the transfer nip part, which is formed by the photosensitive drum 31 and the transfer roller 34, from a bottom to a top. Moreover, arranged upstream of the transfer nip part in the main conveying path 92F is a registration roller pair 93. The sheet is temporarily stopped at the registration roller pair 93, is subjected to skew correction, and then sent to the aforementioned transfer nip part at predetermined timing for the purpose of image transfer. Arranged at appropriate places of the main conveying path 92F and the inverted conveying path 92B are a plurality of conveying rollers for sheet conveyance, and for example, a paper discharge roller pair 94 is arranged near the paper discharge port 14.

The inverted conveying path 92B is formed between an outer side surface of an inversion unit 95 and an inner surface of the rear cover 12 of the main body housing 10. On an inner side surface of the inversion unit 95, the transfer roller 34 and one roller included in the registration roller pair 93 are loaded. The rear cover 12 and the inversion unit 95 are capable of turning around an axis of a supporting point part 121 provided at their bottom ends. In an event of a sheet jam in the inverted conveying path 92B, the rear cover 12 is opened. In an event of a sheet jam in the main conveying path 92F, or when any unit of the photosensitive drum 31 or the developing device 20 is to be taken out, the inverting unit 95 in addition to the rear cover 12 is opened.

<Description of Developing Device>

Figure 4:
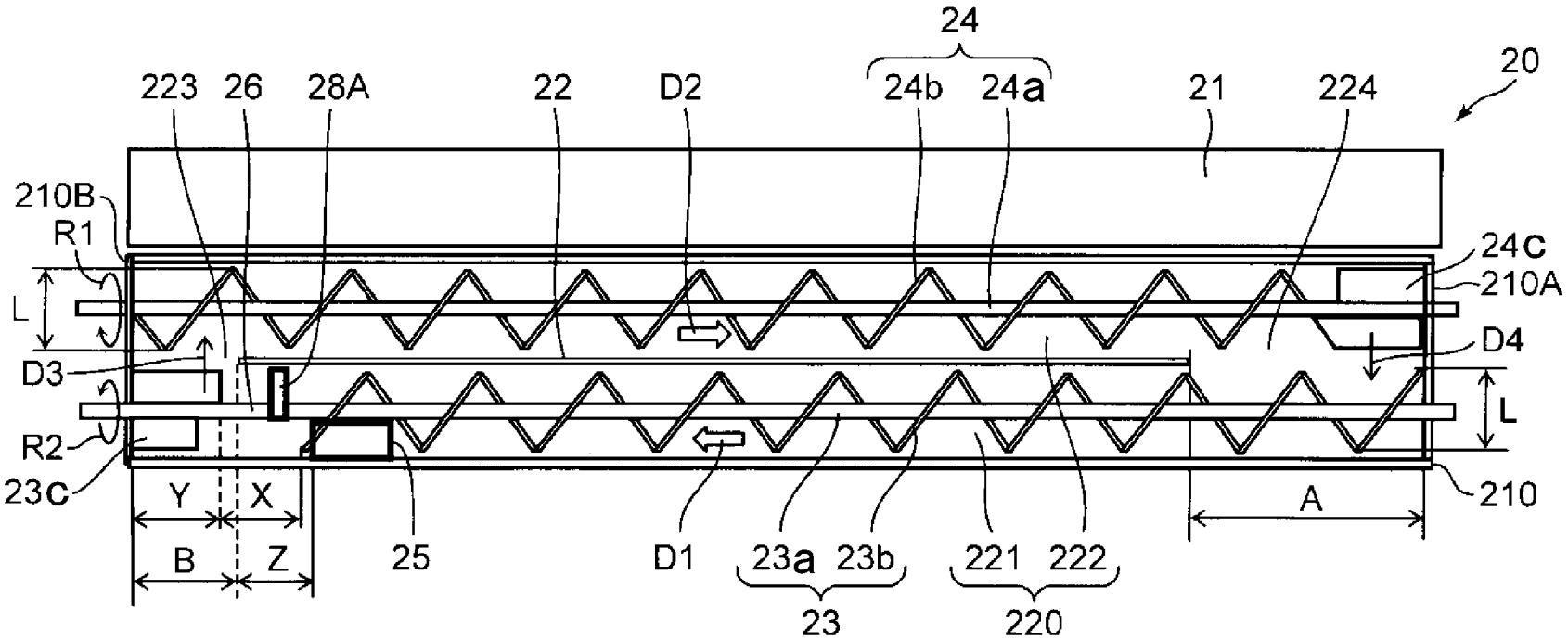
FIG. 4 is a plan view of the developing device according to the first embodiment of this disclosure.

Next, the developing device 20 according to the first embodiment of this disclosure will be described in detail. FIG. 3 is a side sectional view showing inner structure of the developing device 20. FIG. 4 is a plan view showing inner structure of the developing device 20. The developing device 20 includes: the developing housing 210 (housing) having a box shape elongated in one direction (axial direction of the developing roller 21). The developing housing 210 includes: a first wall part 210A and a second wall part 210B (FIG. 4) in a pair. This developing housing 210 has an inner space 220 between the first wall part 210A and the second wall part 210B. Moreover, the developing housing 210 includes a top panel 211 (FIG. 5) defining an upside of the inner space 220.

Disposed in the inner space 220 are: the developing roller 21, a first stirring screw 23 (conveying member), a second stirring screw 24, and a toner refill port 25. In this embodiment, as a one-component development method, a toner containing a magnetic material is stored as a developer in this inner space 220. The toner is conveyed while stirred in the inner space 220, and is successively supplied from the developing roller 21 to the photosensitive drum 31 for the purpose of developing an electrostatic latent image. Note that, in another embodiment, another developer containing a magnetic material, such as a two-component developer, may be used.

The developing roller 21, between the pair of the first wall part 210A and the second wall part 210B, is rotatably supported by the developing housing 210, and carries a developer on its surface. The developing roller 21 has a cylindrical shape extending in a lengthwise direction of the developing housing 210. The developing roller 21 includes: a sleeve 21S of a cylindrical shape that is driven into rotation; and a magnet 21M of a circular-cylinder shape that is firmly arranged along an axial direction inside the sleeve 21S. The sleeve 21S is driven by driving means, not shown, into rotation in the direction of the arrow D31 of FIG. 3, and carries a magnetic toner on its circumferential surface. The magnet 21M is a stationary magnet having, inside the sleeve 21S, a plurality of magnetic poles in a circumferential direction of the sleeve 21S. The magnet 21M includes the four magnetic poles: pole S1, pole N1, pole S2, and pole N2 arranged in the circumferential direction.

In FIG. 3, a curve MC surrounding the developing roller 21 denotes magnetic force in a radius direction of the developing roller 21 which force is provided by the different magnetic poles, in distribution in the circumferential direction on the sleeve 21S. The pole S1 of the magnet 21M is arranged at a top front position. The pole S1 is used as a regulating pole for toner layer regulation. The pole N1 of the magnet 21M is arranged at a top rear position. The pole N1 is provided with, as a developing pole, a function of supplying a toner to the photosensitive drum 31. The pole N2 of the magnet 21M is arranged at a bottom front position. The pole N2 is provided with, as a catch pole, a function of pumping up the toner to the developing roller 21. The pole S2 of the magnet 21M is arranged at a position which is downstream of the pole N1 in a rotation direction of the sleeve 21S and is also upstream of the pole N2 in the rotation direction of the sleeve 21S. The pole S2 of the magnet 21M is mainly arranged at a bottom rear position. The pole S2 is provided with a function as a conveying pole which collects, in the developing housing 210, the toner not moved towards the photosensitive drum 31 at the pole N1. The toner carried on the sleeve 21S is conveyed to an aperture part (not shown) disposed at the developing housing 210, and is supplied to the opposing photoconductive drum 31.

The inner space 220 of the developing housing 210 is covered by the top panel 211 (FIG. 5) and is divided by a divider 22, which horizontally extends, into a first conveyance path 221 and a second conveyance path 222 which are horizontally elongated. The first conveyance path 221 is arranged in the developing housing 210 in a manner such as to be spaced from the developing roller 21. The second conveyance path 222 is arranged between the developing roller 21 and the first conveyance path 221, and supplies a developer to the developing roller 21. The divider 22 is shorter than a horizontal width of the developing housing 210, and provided between a left end and a right end of the divider 22 and the second wall part 210B and the first wall part 210A are a first communication path 223 and a second communication path 224 which respectively communicate with the first conveyance path 221 and the second conveyance path 222. This consequently forms in the inner space 220 a circulation path (developer conveyance path) leading to the first conveyance path 221, the first communication path 223, the second conveyance path 222, and the second communication path 224. The toner is conveyed in the circulation path clockwise in FIG. 4.

Figure 5:
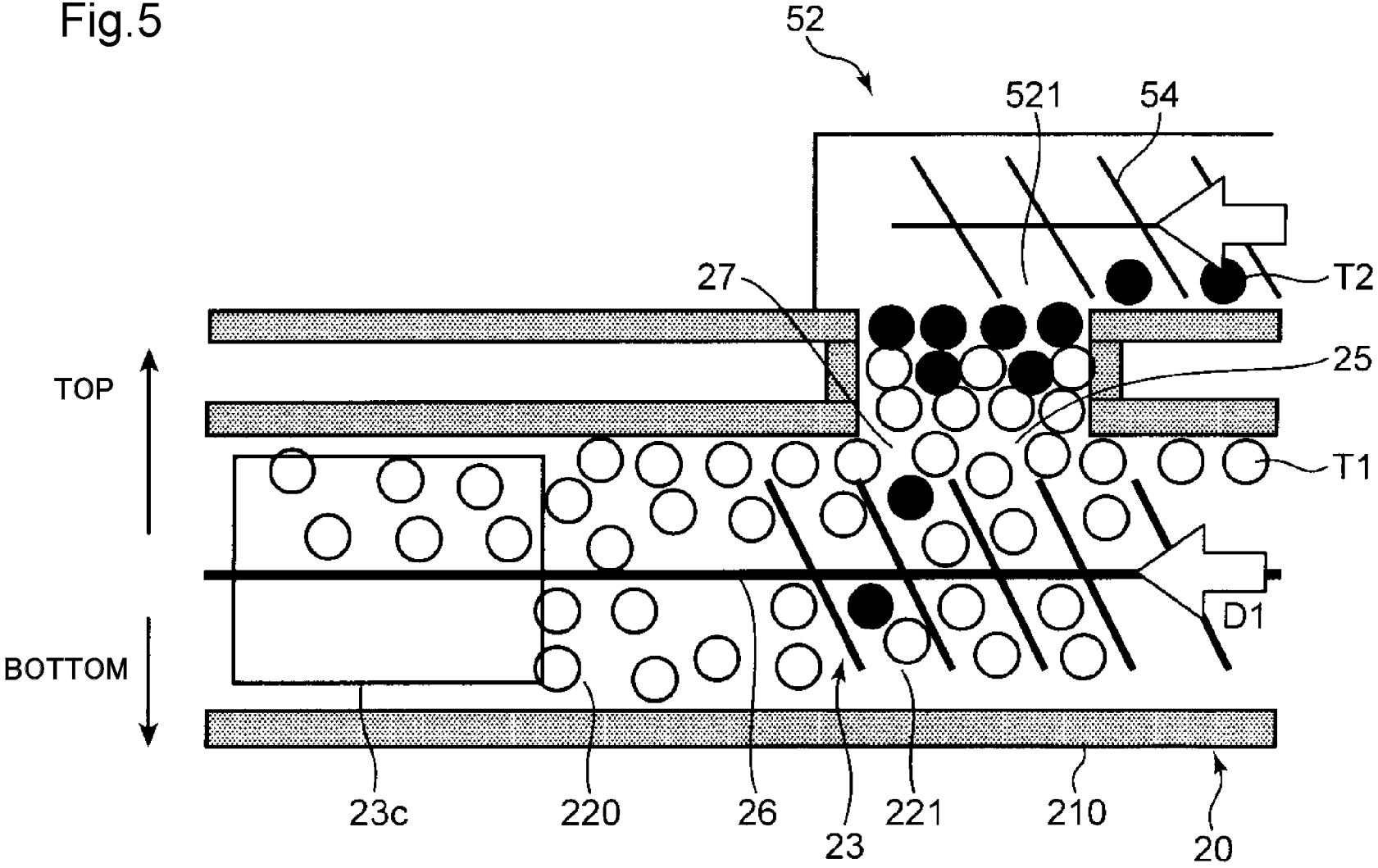
FIG. 5 is a schematic view showing how toner refill is performed in the developing device according to the first embodiment of this disclosure.
Figure 6:
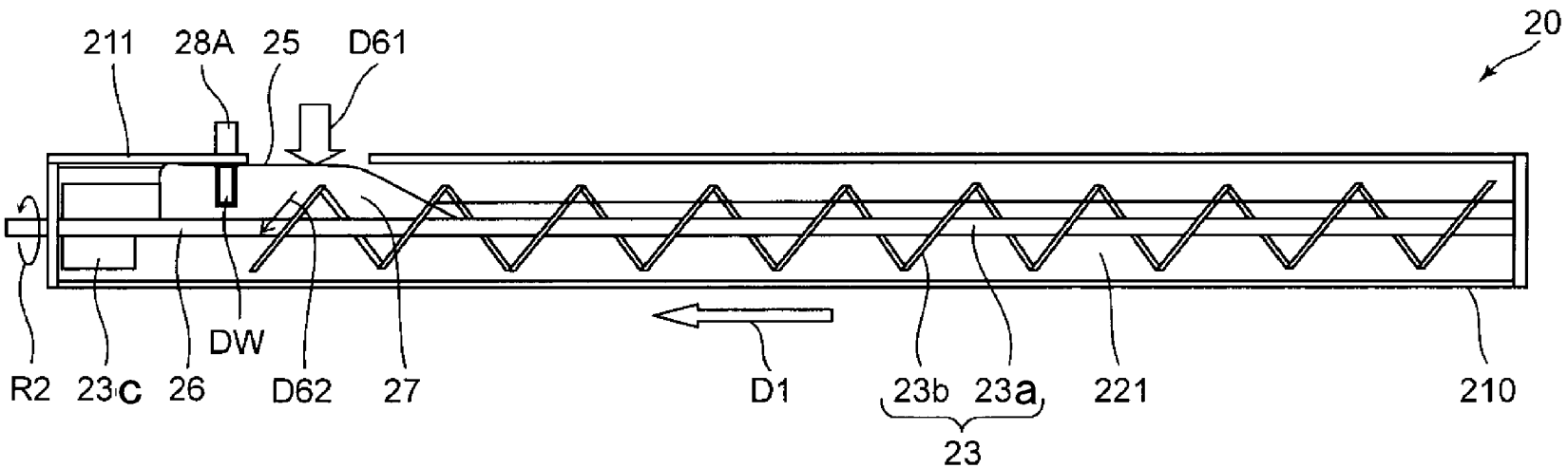
FIG. 6 is a sectional view of the developing device according to the first embodiment of this disclosure.

The toner refill port is an opening part pierced in the top panel 211, and is arranged above the vicinity of a left end of the first conveyance path 221 (downstream in a first direction) (FIGS. 4 to 6). The toner refill port 25 is arranged oppositely to the aforementioned circulation path, and includes a function of receiving, at the first conveyance path 221 of the inner space 220, a refill toner refilled from the toner container 50. In this embodiment, the toner refill port 25 is formed of an opening dimensioned 14 mm×8 mm in plan view.

The first stirring screw 23 is disposed in the first conveying path 221. The first stirring screw 23 includes: a first rotation axis 23*a* (rotation axis); and a first screw blade 23*b* ('screw blade' in claim) projected spirally on circumference of this first rotation axis 23*a*. The first stirring screw 23 is driven into rotation about the first rotation axis 23*a* (an arrow D33 of FIG. 3, an arrow R2 of FIG. 4) by a driver, not shown, thereby conveying the toner in a direction of an arrow D1 of FIG. 4. The first stirring screw 23 conveys the developer so that it passes through a position where the toner refill port 25 opposes the first conveyance path 221. As a result, the first stirring screw 23 is provided with a function of mixing a new toner flowing through the toner refill port 25 with the toner conveyed through the first conveyance path 221 and then transferring the mixed toner towards the second conveyance path 222. In this embodiment, an outer diameter of the first screw blade 23*b* is 14 mm, and an axial pitch is set at 20 mm. In accordance with conveyance performance of the first stirring screw 23, the aforementioned pitch can be changed, but it is preferable in terms of maintenance of toner conveyance capability that a lower limit of the aforementioned pitch be 15 mm. Disposed on a downstream side of the first stirring screw 23 in a toner conveyance direction (direction of the arrow D1) is a first paddle 23*c*. The first paddle 23*c* is a plate-like member disposed on the first rotation axis 23*a*. The first paddle 23*c* is rotated together with the first rotation axis 23*a*, and transfers the toner from the first conveyance path 221 to the second conveyance path 222 in a direction of the arrow D3 of FIG. 4. In this embodiment, an axial length of the first paddle 23*c* is set at 20 mm. Further, the first stirring screw 23 includes a conveyance capability suppressing shaft part 26 (omission part). The conveyance capability suppressing shaft part 26 is a portion in which the first screw blade 23*b* is partially omitted and only the first rotation axis 23*a* is arranged. Oppositely to the conveyance capability suppressing shaft part 26, a magnet 28A to be described later is arranged.

The second stirring screw 24 is disposed on the second conveyance path 222. The second stirring screw 24 includes: a second rotation axis 24*a*; and a second screw blade 24*b* projected spirally on circumference of this second rotation axis 24*a*. The second stirring screw 24 is driven by a driver, not shown, into rotation around the second rotation axis 24*a* (an arrow D32 of FIG. 3, an arrow R1 of FIG. 4), thereby conveying the toner in a direction of an arrow D2 of FIG. 4 (second direction). The second stirring screw 24 conveys the toner in the second conveyance path 222 and also supplies the toner to the developing roller 21. In this embodiment, an outer diameter of the second screw blade 24*b* is 14 mm and an axial pitch is set at 20 mm. In accordance with conveyance performance of the second stirring screw 24, the aforementioned pitch can be changed, but it is preferable in terms of maintenance of toner conveyance capability that a lower limit of the aforementioned pitch be 15 mm.

The second stirring screw 24 is arranged at a position more front and lower than the developing roller 21. That is, the second stirring screw 24 is arranged oppositely to the pole N2 of the magnet 21M. Following the rotation of the second stirring screw 24 (the arrow D32 of FIG. 3), the toner is supplied from the second stirring screw 24 to the sleeve 21S. The second rotation axis 24*a* of the second stirring screw 24 is located below a rotation axis of the sleeve 21S. Further, the second rotation axis 24*a* of the second stirring screw 24 is located below a bottom end part of a circumferential surface of the sleeve 21S. In this embodiment, a path of the toner supply to the developing roller 21 is formed only by a path of the supply from the second stirring screw 24. Therefore, the second stirring screw 24 pumps up the toner from a bottom to a top towards the developing roller 21 to thereby supply the toner to the sleeve 21S.

On a downstream side of the second stirring screw 24 in the toner conveyance direction (direction of the arrow D2), a second paddle 24*c* is disposed. The second paddle 24*c* is a plate-like member disposed on the second rotation axis 24*a*. The second paddle 24*c* is rotated together with the second rotation axis 24*a*, and delivers the toner from the second conveying path 222 to the first conveying path 221 in a direction of an arrow D4 of FIG. 4. In this embodiment, an axial length of the second paddle 24*c* is set at 20 mm.

The developing device 20 further includes: a layer regulating member 60 and a magnet plate 70.

The layer regulating member 60 is arranged at a position more front and upper than the developing roller 21. The layer regulating member 60 is arranged along an axial direction of the developing roller 21 oppositely to the circumferential surface of the developing roller 21 (sleeve 21S). More specifically, the layer regulating member 60 is arranged oppositely to the pole S1 of the magnet 21M included in the developing roller 21. The layer regulating member 60 is a plate-like member formed of a magnetic material. The layer regulating member 60 has a rectangular shape having a longer side extending in a direction towards the developing roller 21 in cross section orthogonal to the rotation axis of the developing roller 21. A tip end part of the layer regulating member 60 is so arranged as to be spaced from the sleeve 21S of the developing roller 21. As a result, between this tip end part and the sleeve 21S, a layer regulating gap G is formed. The layer regulating member 60 regulates a layer thickness of the toner pumped up from the second stirring screw 24 onto the sleeve 21S.

The magnet plate 70 is arranged in front of the layer regulating member 60 along the layer regulating member 60. In other words, the magnet plate 70 is arranged on a side upstream of the layer regulating member 60 in a rotation direction (arrow D31 of FIG. 3) of the sleeve 21S of the developing roller 21. In this embodiment, the magnet plate 70 is formed of a permanent magnet having a plate-like shape. The magnet plate 70 has a substantially rectangular shape extending along the layer regulating member 60 in cross section orthogonal to the rotation axis of the developing roller 21. The magnet plate 70 is fixed at a bottom portion of the layer regulating member 60. The magnet plate 70 is provided with magnetic force of a south pole same in polarity as the pole S1. Moreover, the magnet plate 70 includes a north pole at a position more distant from the pole S1 of the magnet 21M than the aforementioned south pole.

As described above, in this embodiment, the magnet plate 70 is arranged on the side upstream of the layer regulating member 60 in the rotation direction of the developing roller 21 (sleeve 21S). In other words, from the upstream side towards a downstream side in the rotation direction of the developing roller 21, the magnet plate 70 and the layer regulating member 60 are arranged oppositely to the circumferential surface of the developing roller 21 in just mentioned order.

The second stirring screw 24 supplies the toner to the sleeve 21S in a direction towards a first position P1 facing a vertical bottom of a circumferential surface of the sleeve 21S, and the layer regulating member 60 regulates a thickness of the toner on the sleeve 21S at a second position P2 which faces a vertical top of the circumferential surface of the sleeve 21S and which is located above the first position P1. At this point, the pole S1 of the magnet 21M and the south pole of the magnet plate 70 have magnetic force of the same pole, and thus a repulsive magnetic field acts between the sleeve 21S and the magnet plate 70. This repulsive magnetic field is classified into a magnetic field directed towards an upstream side in a rotation direction of the sleeve 21S and a magnetic field directed towards a downstream side in the rotation direction thereof (layer regulating member 60 side). Thus, the toner conveyed on the sleeve 21S and entering into a bottom part of the magnet plate 70 is provided with force with which it moves on the circumferential surface of the sleeve 21S. As a result, with the toner being thin-layered, the toner layer regulation is realized. Further, the toner not entering into the layer regulating gap G of the layer regulating member 60 is prompted to the repulsive magnetic field and flows towards the upstream side in the rotation direction of the sleeve 21S.

Further, in this embodiment, the developing device 20 includes the magnet 28A (FIGS. 3 and 4). The magnet 28A is arranged at the top panel 211 of the developing housing 210. More specifically, the magnet 28A is a magnet fixed at the top panel 211 downstream of the toner refill port 25 in the first direction. In this embodiment, the magnet 28A is arranged above a first region A1 (see FIG. 7A) of the first conveyance path 221 where the first screw blade 23*b* rotates downwardly from a top. Then the magnet 28A forms a magnetic brush DW of a developer from the top panel 211 of the first conveyance path 221 towards the first stirring screw 23.

<Accumulation Part>

The aforementioned toner container 50 is arranged above the toner refill port 25 of the developing housing 210. The toner container 50 includes: a toner conveyance path 50*a* to inside of which the toner is conveyed; the rotation member 54; and the toner discharge port 521. The toner container 50 is assembled to the developing device 20 in a manner such that a longitudinal direction of the toner container 50 (direction in which the toner conveyance path 50*a* is formed) is located in a direction orthogonal to a longitudinal direction of the developing device 20 (a direction in which the developer is conveyed by the first stirring screw 23. The direction of the arrow D1, the first direction).

The toner discharge port 521 is disposed at a bottom part of the toner container 50 in correspondence with the toner refill port 25 of the developing device 20. The rotation member 54 has: an axis part, and a blade part rotated around the axis part (see FIG. 2 and FIG. 5), and conveys the refill toner in the toner conveying path 50*a* towards the toner discharge port 521. The toner dropping from the toner discharge port 521 is refilled into the developing device 20 via the toner refill port 25.

Next, a flow of a toner newly refilled through the toner refill port 25 in the developing device 20 according to this embodiment will be described. FIG. 5 is a sectional view of vicinity of the toner refill port 25 disposed in the developing device 20 and the toner discharge port 521 disposed in the toner container 50. In FIG. 5, for explanation, the arrangement of the toner container 50 is shown by horizontally rotating the toner container 50 through 90 degrees. Practically, the rotation member 54 in the toner container 50 extends forwardly of a paper surface, and the first stirring screw 23 and the rotation member 54 in the toner container 50 have positional relationship in which they are orthogonal to each other.

A refill toner T2 supplied from the toner discharge port 521 of the toner container 50 drops into the first conveying path 221 and is mixed with an existing toner T1, and is conveyed in the direction of the arrow D1 by the first stirring screw 23. At this point, the toners T1 and T2 are stirred and charged.

The first stirring screw 23 includes the aforementioned conveyance capability suppressing shaft part 26 (FIG. 4) downstream of the toner refill port 25 in the toner conveyance direction. The conveyance capability suppressing shaft part 26 is formed by omitting the first screw blade 23*b* of the first stirring screw 23. In this embodiment, an axial length of the conveyance capability suppressing shaft part 26 is set at 12 mm. In other words, the conveyance capability suppressing shaft part 26 corresponds to a portion where only the first rotation axis 23*a* is partially disposed. In this case, the conveyance capability suppressing shaft part 26 does not have developer conveyance performance for an axial direction of the first rotation axis 23*a*.

Thus, the toner flowing into the first conveyance path 221 through the toner refill port 25 is caused by the conveyance capability suppressing shaft part 26 to start to accumulate. Then this toner accumulation reaches up to a position which is on an immediate upstream side of the conveyance capability suppressing shaft part 26 and at which the toner refill port 25 opposes the first conveyance path 221. As a result, near an inlet of the toner refill port 25, an accumulation part 27 for a toner is formed.

Upon an increase in the amount of toner in the inner space 220 as a result of refill of the refill toner T2 from the toner refill port 25, the toner accumulating at this accumulation part 27 closes (seals) the toner refill port 25, inhibiting further toner refilling. Then upon a decrease in the toner accumulating at the accumulation part 27 as a result of consumption of the toner in the inner space 220 from the developing roller 21, the toner closing the toner refill port 25 decreases, forming a space between the accumulation part 27 and the toner refill port 25. As a result, the refill toner T2 flows again from the toner refill port 25 into the inner space 220. As described above, adopted in this embodiment is a toner refill method of a volume refill type by which the amount of refill toner to be received is adjusted following a decrease in the toner accumulating at the accumulation part 27.

<Refill Toner Dispersion>

Figure 8:
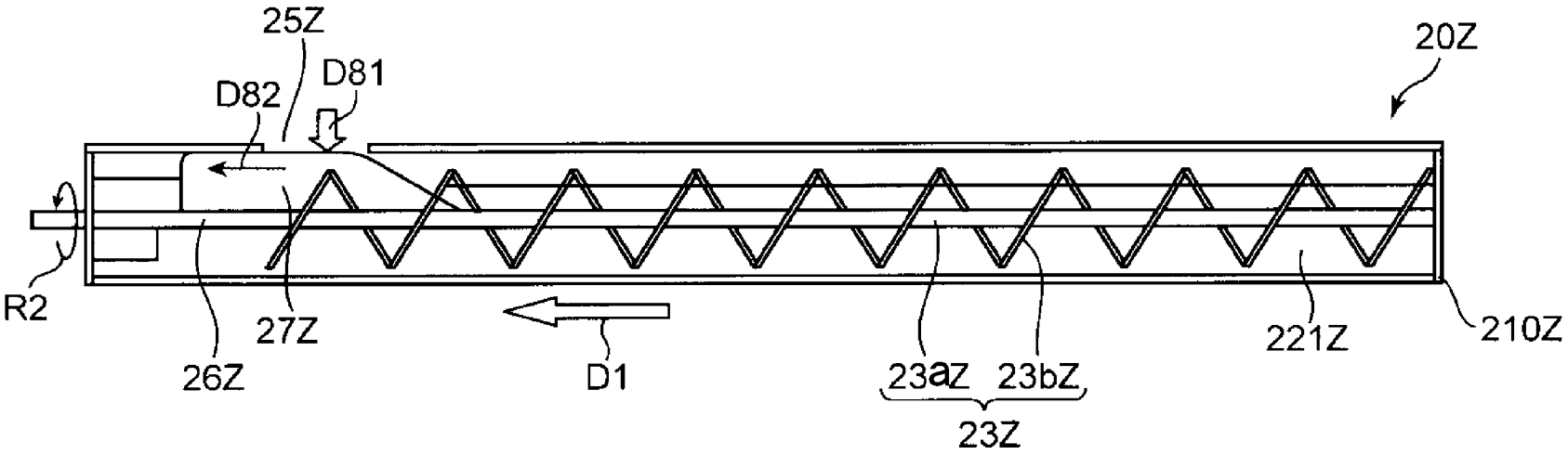
FIG. 8 is a sectional view illustrating a developer flow in another developing device compared to the developing device according to the embodiment of this disclosure.

Next, a problem associated with toner refill in a developing device 20Z compared to this embodiment for reference will be described. FIG. 8 is a sectional view of the developing device 20Z. FIG. 8 corresponds to a diagram of a first conveyance path 221Z viewed from a front. The developing device 20Z, as is the case with the developing device 20 of this embodiment, includes a conveyance capability suppressing shaft part 26Z obtained by partially omitting a screw blade. The conveyance capability suppressing shaft part 26Z has no conveyance capability for an axial direction, and thus an accumulation part 27Z is formed in a region opposing a toner refill port 25Z. Then in accordance with an amount of toner at the accumulation part 27Z, from a toner container, not shown, a toner is refilled to the toner refill port 25Z.

In the developing device 20Z provided with the toner refill method of the volume refill type as described above, upon a decrease in the toner remaining in the toner container, the amount of toner refilled decreases, which also results in a decrease in the amount of toner in the developing housing 210Z. In this case, upon detection by a concentration sensor, not shown, that the remaining toner is little, toner container replacement is prompted. At this point, the amount of toner in a developing housing 210Z has decreased, thus resulting in a state in which the amount of toner at the accumulation part 27Z has also decreased. Then from a new toner container fitted to the developing device 20Z by a user, a refill toner is flowed into the developing housing 210Z. Since a large amount of toner is filled in the new toner container, the refill toner forcibly and easily flows towards the developing housing 210Z.

The toner flowing into the developing housing 210Z enters into the accumulation part 27Z. Then following driven rotation of a first stirring screw 23Z, the toner is conveyed to a second conveyance path 222Z (not shown) communicating from the first conveyance path 221Z. At this point, between the large amount of refill toner refilled from the new toner container into the developing housing 210Z and the toner already circulated inside the developing housing 210, there are differences in surface nature and electrification characteristics in many cases. As a result of circulation of the both toners in the developing housing 210Z, their properties gradually become close to each other, but immediately after the flow-in of the refill toner, toner charging may be polarized due to a difference between surfaces states of the both toners. That is, one of the toners described above is charged to a positive polarity, and the other thereof is charged to a negative polarity. As a result, developer fogging may occur on images on the photosensitive drum 31 and the sheet.

In addition, the new refill toner drastically flowing into the developing housing 210Z hardly sinks towards a bottom part side of the developing housing 210Z even when it receives rotational force of the first stiffing screw 23Z. Especially at the conveyance capability inhibition part 26Z downstream of the toner refill port 25Z, a toner stiffing capability is low, and thus toner dispersion is hardly performed. In this case, the refill toner flowing into the developing housing 210Z flows towards the second conveyance path 222Z via a first communication path 223Z (not shown) while flowing on a surface layer (top layer, deep-draft surface portion) of toner layers of the first conveyance path 221Z (arrow D82). Then upon supply of the toner, flowed into the second conveyance path 222Z without being sufficiently dispersed, as a clot directly to a developing roller 21Z (not shown), there arises a problem that longitudinally linear fogging occurs on an image.

<Magnetic Member>

Figure 7B:
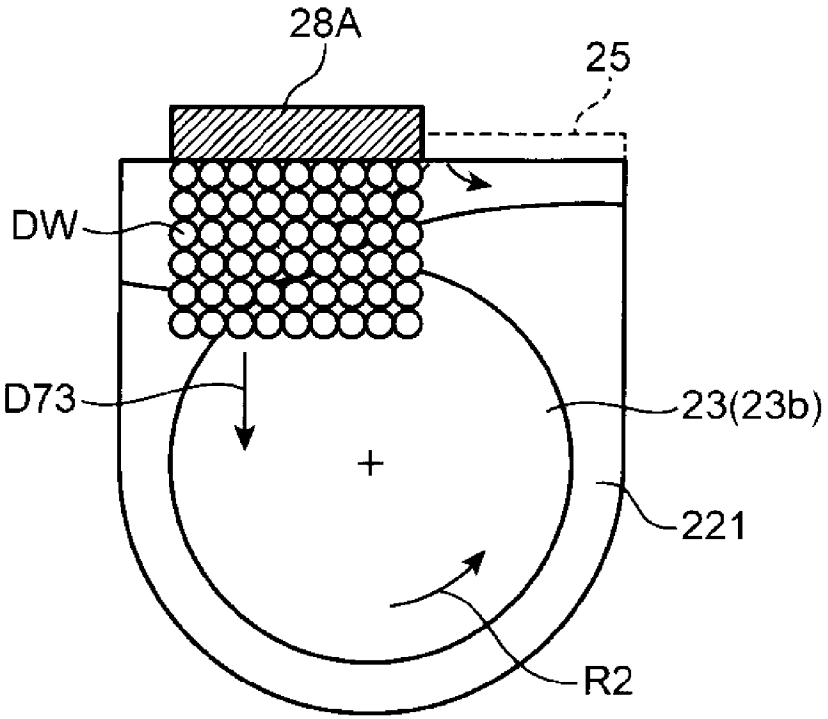
FIGS. 7A and 7B are schematic sectional views showing a toner flow in the developing device according to the first embodiment of this disclosure.
Figure 7A:
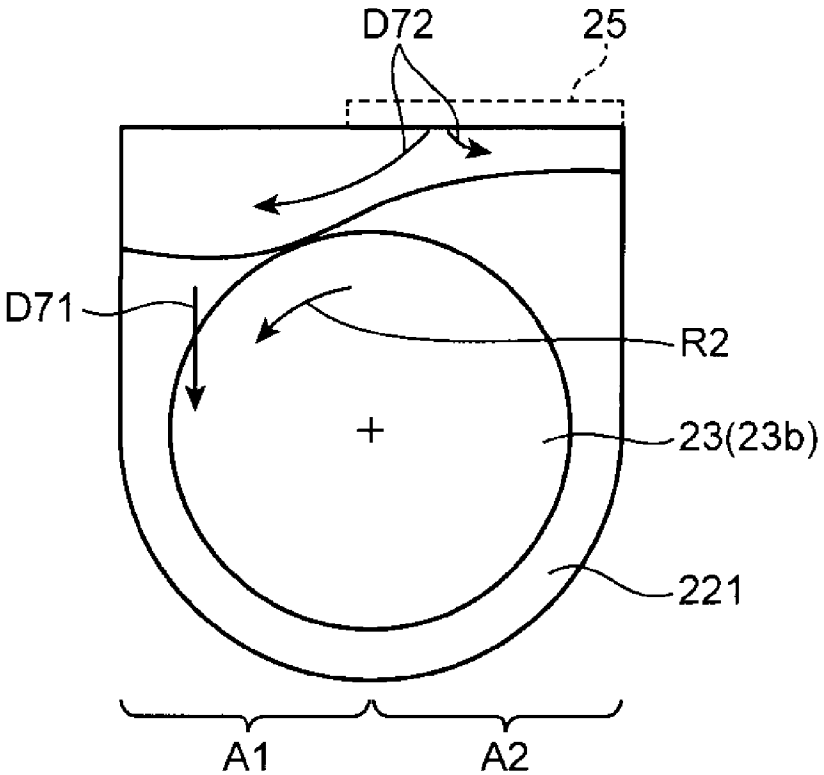

To solve the problem as described above, the developing device 20 according to this embodiment includes the aforementioned magnet 28A (magnetic member). FIG. 6 is a sectional view of the first conveyance path 221 of the developing device 20, viewed from a front. FIG. 7 are schematic sectional views illustrating a toner flow on a downstream side of the toner refill port 25 of the first conveyance path 221. FIG. 7A is the sectional view in a case where the magnet 28A according to this embodiment is not included, while FIG. 7B is the sectional view in a case where the magnet 28A is included.

As shown in FIG. 6, the magnet 28A forms a magnetic brush DW with a predetermined height from the top panel 211 towards the first stirring screw 23. The magnet 28A is so provided as to extend in a direction crossing the axial direction (first direction) of the first rotation axis 23*a*. Thus, the aforementioned magnetic brush DW is plurally formed in the direction crossing the aforementioned axial direction, and a wall of the magnetic brushes DW is formed. Note that the magnet 28A has a south pole on a side in contact with the top panel 211 and a north pole opposite to the top panel 211. Part of the developer flowing inside the first conveyance path 221 is drawn to a magnetic field formed by the magnet 28A, whereby the aforementioned magnetic brushes DW are formed. In this embodiment, the magnetic brushes DW are formed oppositely to the conveyance capability suppressing shaft part 26 as a portion where the first screw blade 23*b* is not present. This therefore suppresses scraping off of the aforementioned magnetic brushes DW by the first screw blade 23*b* of the first stirring screw 23.

In this embodiment, as shown by an arrow D61 of FIG. 6, the refill toner flowing in through the toner refill port 25, with rotational force of the first stirring screw 23, is guided downwardly by the magnetic brushes DW, and is conveyed in a manner such as to fall below the magnetic brushes DW (arrow D62). Therefore, the aforementioned refill toner is favorably mixed with the surrounding toner. In other words, the refill toner is prevented from being supplied to the second conveyance path 222 and the developing roller 21 in an insufficiently dispersed state while sliding on a top layer (deep-draft surface) of toner layers on the downstream side of the toner refill port 25. Moreover, the magnetic brushes DW are so arranged by the magnet 28A as to enter closely to the first rotation axis 23*a* than the outer diameter of the first screw blade 23*b* of the first stirring screw 23. Thus, the accumulation part 27 is stably formed below the toner refill port 25. Moreover, the refill toner flowing in through the toner refill port 25 is conveyed in a manner such as to fall even more downward.

Further, in this embodiment, as described above, the magnet 28A is arranged above the first region A1 (see FIG. 7A) of the first conveyance path 221 where the first screw blade 23*b* rotates downwardly from the top. Referring to FIG. 7A, the toner deep-draft surface is located at a lower section for the first region A1 where the first screw blade 23*b* rotates downwardly from the top than for the second region A2 where the first screw blade 23*b* rotates upwardly from the bottom. This is because the toner is conveyed by the rotational force of the first screw blade 23*b* of the first stirring screw 23 while pressed downwardly in the first region A1 (arrow D71 of FIG. 7A). Thus, the refill toner flowing into the first conveyance path 221 through the toner refill port 25, as shown by arrows D72, more easily flows towards the first region A1 than towards the second region A2. Therefore, as shown in FIG. 7B, forming the magnetic brushes DW above the first region A1 makes it possible for the flowing-in refill toner to fall below the magnetic brushes DW (arrow D73). This consequently prevents the refill toner from being conveyed while making upper sliding, which favorably promotes stiffing of the refill toner and the other toners.

Figure 9:
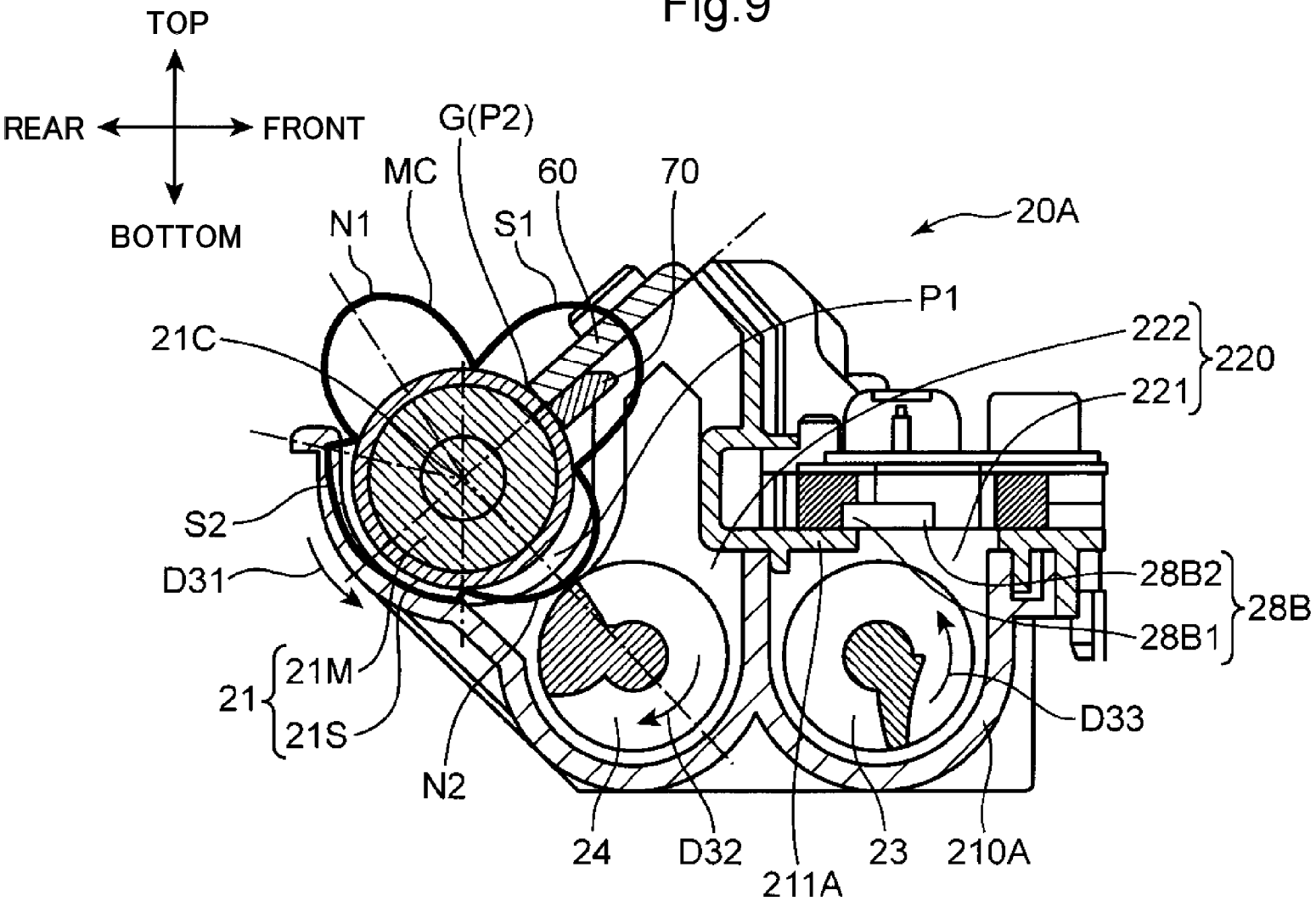
FIG. 9 is a sectional view of a developing device according to a second embodiment of this disclosure, viewed from a side.

Next, a developing device 20A according to the second embodiment of this disclosure will be described. FIG. 9 is a side sectional view showing inner structure of the developing device 20A. A difference between this embodiment and the former embodiment lies in that in the developing device 20A according to this embodiment, instead of the magnet 28A of the developing device 20 according to the former embodiment, a magnet 28B is included. Thus, the following description is given, focusing on this different point while omitting description of other common points.

The magnet 28B, as is the case with the magnet 28A, is arranged at a top panel 211A of a developing housing 210A. More specifically, the magnet 28B is a magnet fixed at the top panel 211A downstream of the toner refill port 25 in the first direction (see FIG. 4). In this embodiment, the magnet 28B is arranged above the first region A1 (see FIG. 7A) of the first conveyance path 221 where the first screw blade 23*b* rotates downwardly from the top and above the second region A2 of the first conveyance path 221 where the first screw blade 23*b* rotates upwardly from the bottom. More specifically, the magnet 28B includes: a first portion 28B1 above the first region A1; and a second portion 28B2 above the second region A2. This consequently forms a magnetic brush (not shown) from the top panel 211A of the first conveyance path 221 towards the first stirring screw 23 in a state in which it extends across the first region A1 and the second region A2 of the first conveyance path 221.

Also in the developing device 20A provided with such a magnet 28B, a refill toner is favorably prevented from sliding on a top layer of toner layers. Further, stirring of the refill toner and other toners is favorably promoted. Setting magnetic force of the first portion 28B1 of the magnet 28B to be larger than magnetic force of the second portion 28B2 makes it possible to form more magnetic brushes in the first region A1 into which the refill toner easily flows. In this case, the magnetic brushes extend more downwardly from the top panel 211A in the first region A1, thus making it possible for the refill toner to fall down to an even lower portion of the toner layer.

EXAMPLE 1

Next, contents shown by this disclosure will be further described, based on examples. Note, however, that the contents shown by this disclosure are not limited by the following examples. The following different experiments were performed under the following common experiment conditions.

<Common Experiment Conditions>

- Photoconductive drum 31: OPC drum
- Circumferential speed of the photosensitive drum 31: 146 mm/sec.
- Layer regulating gap G: 0.3 mm
- Developing bias AC component: rectangular wave amplitude 1.2 kV, Duty 50% Developing bias DC component: 300V
- Surface potential (background part/image part) of the photosensitive drum 31: 430V/60V
- Diameter of the developing roller 21: 16 mm
- Diameter of the photosensitive drum 31: 24 mm
- Average particle diameter of the magnetic toner: 6.8 μm (D50)
- Shapes of the first stirring screw 23 and the second stirring screw 24: Outer diameter 14 mm, Screw pitch 20 mm
- Number of rotations of the first stirring screw 23 and the second stirring screw 24: 50 rpm Axial length X of the conveyance capability suppressing shaft part 26: 12 mm Axial opening width B of the first communication path 223: 20 mm Axial opening width A of the second communication path 224: 40 mm Opening shape of the toner refill port 25: 14×8 mm Shortest axial distance Z between the toner refill port 25 and the first communication path 223: 10 mm Shortest axial distance between the toner refill port 25 and the second communication path 224: 140 mm Experiment Procedures First, a new toner container 50 is fitted to the image forming apparatus 1, and an image with a print rate of 3.8% is continuously printed until a toner in the toner container 50 becomes empty. In this state, a brand new toner container 50 whose weight was previously measured is further fitted to the image forming apparatus 1. Then after 100 white sheets were printed, refill fogging was evaluated. The refill fogging is a phenomenon in which toner fogging occurs on a full surface of the sheet as a result of unstable charging between a new toner flowing from the toner container 50 and the toner circulating in the developing housing 210.

In this experiment, for magnet positions, a position of the magnet 28A shown in FIG. 3 is defined as a magnet position A, and a position of the magnet 28B shown in FIG. 9 is defined as a magnetic position B. Then by varying magnetic force of each of the magnet 28A and the magnet 28B between 45 mT and 70 mT, the aforementioned refill fogging was evaluated. The refill fogging evaluation was performed at a sheet background portion. Of levels of the refill fogging, ○ denotes a state in which no fogging is occurring, i.e., a non-problematic level, Δ denotes a level in which fogging is slightly occurring at a practically non-problematic level, and x denotes a state in which fogging is occurring.

Table 1 shows results of the refill fogging. As shown in Table 1, at the magnet position A, that is, with the arrangement of the magnet 28A shown in FIG. 3, the refill fogging was at a non-problematic level under both conditions of the magnetic force of 45 mT and the magnetic force of 70 mT. This means that, as described above, as a result of forming the strong magnetic brushes DW for the first region A1 where the first screw blade 23*b* of the first stiffing screw 23 rotates downwardly from the top, upper sliding of the refill toner is favorably prevented. Moreover, at the magnet position B, that is, with the arrangement of the magnet 28B shown in FIG. 9, slight refill fogging occurred under the condition of the magnetic force of 45 mT, but the refill fogging was at a practically non-problematic level under the both any magnetic force conditions.

TABLE 1

| | Magnet position | Magnetic force of magnet | Refill fogging |
|---|---|---|---|
| Examle 1 | A | 45 mT | ○ |
| Examle 2 | A | 70 mT | ○ |
| Examle 3 | B | 45 mT | Δ |
| Examle 4 | B | 70 mT | ○ |
| Comparative example 1 | N/A | N/A | x |

As described above, according to each of the aforementioned embodiments, the magnets 28A and 28B form, on the first conveyance path 221 downstream of the toner refill port 25 in the first direction, the magnetic brushes DW from the top panel 211 towards the first stirring screw 23. Specifically, on the top panel 211 side of the first conveyance path 221, a wall of the magnetic brushes DW is formed. Therefore, the refill toner flowed into the first conveyance path 221 is conveyed by the first stiffing screw 23 in a manner such as to fall below the plurality of magnetic brushes DW. Thus, the refill toner is favorably stirred and mixed with the surrounding toner. As a result, in a state in which the refill toner is sufficiently dispersed, the refill toner is flowed into the second conveyance path 222 and then supplied to the developing roller 21. Moreover, the refill toner is prevented from being conveyed to the second conveyance path 222 while sliding on the top layer of the toner layers of the first conveyance path 221.

For example, in a typical developing device, in a case where a large amount of toner has flowed into the developing housing from the toner container, due to a difference in surface state between the toner already circulated inside the developing housing and the new refilled toner, toner charging may be polarized. That is, one of the aforementioned toners is charged to a positive side while the other one is charged to a negative side. As a result, developer fogging may have occurred in an image forming apparatus loaded with a developing device.

Further, in this typical developing device, the new toner drastically flowing into the developing housing is easily supplied to the developing roller while sliding on the top layer of the toner layers without sufficiently dispersed inside the developing housing. In this case, longitudinally linear developer fogging occurs on the image. However, as described above, in this embodiment, it is possible to prevent occurrence of the developer fogging as a result of supply of the toner refilled into the developing housing to the developing roller while the toner is not sufficiently dispersed.

Moreover, according to the aforementioned embodiments, the toner refill port 25 is arranged oppositely to a position on the downstream side of the first conveyance path 221 in the first direction. With this configuration, through the toner refill port 25 arranged on the downstream side of the first conveyance path 221 in the first direction, the refill toner flowing into the first conveyance path 221 is conveyed towards the second conveyance path 222 in a relatively short period of time. Even in such a case, the refill toner flowing into the first conveyance path 221 is conveyed by the first stirring screw 23 in a manner such as to fall below the plurality of magnetic brushes DW. Thus, while sufficiently dispersed, the refill toner is flowed into the second conveyance path 222 and then supplied to the developing roller 21.

Moreover, according to the aforementioned embodiments, formed at a position opposing the toner refill port 25 by the conveyance capability suppressing shaft part 26 of the first stirring screw 23 is the accumulation part 27 for the toner. Thus, in accordance with a change in an amount of toner at the accumulation part 27, the refill toner is flowed from the toner container 50 to the first conveyance path 221. Then even in a case where the amount of toner at the accumulation part 27 has decreased and the refill toner has flowed into the first conveyance path 221, the refill toner flowed into the first conveyance path 221 is conveyed by the first stiffing screw 23 in a manner such as to fall below the plurality of magnetic brushes DW.

Moreover, according to the aforementioned embodiments, in sectional view crossing the first direction, the magnet 28A forms the magnetic brushes DW at least above the first region A1 of the first conveyance path 221 where the first screw blade 23*b* rotates downwardly from the top. With this configuration, by the rotational force of the first screw blade 23*b*, the toner in the first region A1 is conveyed through the first conveyance path 221 while being pressed downward. Thus, a gap is formed above the first region A1, and the refill toner easily flows therein. Therefore, forming the magnetic brushes DW in correspondence with the first region A1 into which the refill toner easily flows makes it possible to favorably convey the aforementioned flowing-in refill toner to below the magnetic brushes DW.

Moreover, according to the aforementioned embodiments, in the sectional view crossing the first direction, the magnet 28B forms the magnetic brushes DW above the first region A1 of the first conveyance path 221 where the first screw blade 23*b* rotates downwardly from the top and above the second region A2 of the first conveyance path 221 where the first screw blade 23*b* rotates upwardly from the bottom. With this configuration, in the sectional view crossing the first direction, the magnetic brushes DW are formed in a manner such as to cover the first region A1 and the second region A2. Thus, the refill toner flowing into the first conveyance path 221 can be stably conveyed to below the toner layers.

As described above, the developing devices 20 and 20A and the image forming apparatus 1 provided therewith according to the embodiments of this disclosure have been described, but contents indicated by this disclosure are not limited thereto, and thus, for example, a modified embodiment as described below can be adopted.

(1) In the aforementioned embodiments, the toner refill from the toner container 50 to the developing device 20 has been described in a mode adjusted by the accumulation part 27, but the contents indicated by this disclosure are not limited thereto. A permitted mode is such that in accordance with results of detection by a concentration sensor, not shown, which detects image concentration and by a toner sensor, not shown, which detects an amount of toner in the developing housing 210 (210A), the toner is refilled from the toner container 50 to the developing housing 210 (210A).

(2) In the aforementioned embodiments, a mode in which a magnetic toner is adopted as a developer has been described, but the contents indicated by this disclosure are not limited thereto. As a developer, a two-component developer containing magnetic carriers may be adopted.

(3) The aforementioned embodiments have been described by referring to the magnet 28A arranged above the first region A1 and further the magnet 28B arranged above the first region A1 and the second region A2, but the contents indicated by this disclosure are not limited thereto. The magnet forming the magnetic brushes may be arranged only above the second region A2. Even in this case, conveying the toner refilled through the toner refill port 25 in a manner such as to fall below the magnetic brushes consequently prevents upper sliding of the refill toner and also favorably promotes stiffing of the refill toner and the other toners. Moreover, each of the aforementioned magnets may be in a mode fixed to outside of the top panel 211 or a mode embedded in the top panel 211 and partially exposed to the first conveyance path 221.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising:

a housing including a pair of wall parts, and a top panel being provided between the pair of wall parts in a manner such as to bridge therebetween, the housing storing a developer;

a refill developer storage part being attachable and detachable to and from the housing and storing a refill developer to be refilled to the housing;

a developing roller being rotatably supported by the housing between the pair of wall parts and carrying the developer;

a developer conveyance path including a first conveyance path being arranged in the housing in a manner such as to be spaced from the developing roller and having the developer conveyed therethrough in a first direction, and a second conveyance path being arranged between the developing roller and the first conveyance path, having the developer conveyed therethrough towards a second direction opposite to the first direction, and supplying the developer to the developing roller, the developer conveyance path having a top thereof defined by the top panel and having the developer conveyed therethrough in a circulating manner;

a developer receiving port being disposed at the top panel oppositely to the first conveyance path and receiving the refill developer onto the first conveyance path;

a conveyance member being disposed on the first conveyance path, being driven into rotation, and conveying the developer in the first direction in a manner such that the developer passes through a position where the developer receiving port opposes the first conveyance path; and a magnetic member being arranged in the housing and forming, on the first conveyance path downstream of the developer receiving port in the first direction, a magnetic brush of the developer directed from the top panel towards the conveyance member, wherein the conveyance member includes a rotation axis being provided in a manner such as to extend in the first direction, and a screw blade being formed around the rotation axis, and wherein the conveyance member includes, in a region opposing the magnetic member in the first direction, an omission part where the screw blade is partially omitted.

2. The developing device according to claim 1, wherein a first communication path communicating from the first conveyance path to the second conveyance path is provided in an end region on a downstream side on the first conveyance path in the first direction, and the developer receiving port is arranged at a position on the downstream side of the first conveyance path in the first direction and more upstream of the first communication path in the first direction.

3. The developing device according to claim 1, wherein, in a sectional view crossing the first direction, the magnetic member forms the magnetic brush above at least a first region of the first conveyance path where the screw blade rotates downwardly from a top.

4. The developing device according to claim 1, wherein, in a sectional view crossing the first direction, the magnetic member forms the magnetic brush in a region bridging between above the first region of the first conveyance path where the screw blade rotates downwardly from the top and above a second region of the first conveyance path where the screw blade rotates upwardly from a bottom.

5. A developing device comprising:

a housing including a pair of wall parts, and a top panel being provided between the pair of wall parts in a manner such as to bridge therebetween, the housing storing a developer;

a refill developer storage part being attachable and detachable to and from the housing and storing a refill developer to be refilled to the housing;

a developing roller being rotatably supported by the housing between the pair of wall parts and carrying the developer;

a developer conveyance path including a first conveyance path being arranged in the housing in a manner such as to be spaced from the developing roller and having the developer conveyed therethrough in a first direction, and a second conveyance path being arranged between the developing roller and the first conveyance path, having the developer conveyed therethrough towards a second direction opposite to the first direction, and supplying the developer to the developing roller, the developer conveyance path having a top thereof defined by the top panel and having the developer conveyed therethrough in a circulating manner;

a developer receiving port being disposed at the top panel oppositely to the first conveyance path and receiving the refill developer onto the first conveyance path;

a conveyance member being disposed on the first conveyance path, being driven into rotation, and conveying the developer in the first direction in a manner such that the developer passes through a position where the developer receiving port opposes the first conveyance path; and a magnetic member being arranged in the housing and forming, on the first conveyance path downstream of the developer receiving port in the first direction, a magnetic brush of the developer directed from the top panel towards the conveyance member, wherein the conveyance member includes a rotation axis being provided in a manner such as to extend in the first direction, and a screw blade being formed around the rotation axis, wherein, in a sectional view crossing the first direction, the magnetic member forms the magnetic brush in a region bridging between above the first region of the first conveyance path where the screw blade rotates downwardly from the top and above a second region of the first conveyance path where the screw blade rotates upwardly from a bottom, and wherein magnetic force of a first portion of the magnetic member located above the first region is set to be larger than magnetic force of a second portion located above the second region.

6. An image forming apparatus comprising:

a developing device;

an image carrier having an electrostatic latent image formed on a surface thereof and receiving supply of a developer from a developing roller; and a transfer device transferring an image from the image carrier onto a sheet, wherein the developing device comprises a housing including a pair of wall parts and a top panel provided in a manner such as to bridge between the pair of wall parts, the housing storing the developer provided with magnetic property;

a refill developer storing part being attachable and detachable to and from the housing and storing a refill developer to be refilled to the housing;

the developing roller being rotatably supported by the housing between the pair of wall parts and carrying the developer;

a developer conveyance path including a first conveyance path being arranged in the housing in a manner such as to be spaced from the developing roller and having the developer conveyed therethrough in a first direction, and a second conveyance path being arranged between the developing roller and the first conveyance path, having the developer conveyed therethrough in a second direction opposite to the first direction, and supplying the developer to the developing roller, having a top thereof defined by the top panel, and having the developer conveyed therethrough in a circulating manner;

a developer receiving port being disposed at the top panel oppositely to the first conveyance path and receiving the refill developer onto the first conveyance path;

a conveyance member being disposed on the first conveyance path, being driven into rotation, and conveying the developer in the first direction in a manner such that the developer passes through a position where the developer receiving port opposes the first conveyance path; and a magnetic member being arranged in the housing and forming, on the first conveyance path downstream of the developer receiving port in the first direction, a magnetic brush of the developer directed from the top panel towards the conveyance member, wherein the conveyance member includes a rotation axis being provided in a manner such as to extend in the first direction, and a screw blade being formed around the rotation axis, and wherein the conveyance member includes, in a region opposing the magnetic member in the first direction, an omission part where the screw blade is partially omitted.

* * * * *